US007777558B2

(12) United States Patent
Chen

(10) Patent No.: US 7,777,558 B2
(45) Date of Patent: Aug. 17, 2010

(54) BANDGAP REFERENCE CIRCUIT

(75) Inventor: Bo-Wei Chen, Miaoli County (TW)

(73) Assignee: Industrial Technology Research Institute (TW)

( * ) Notice: Subject to any disclaimer, the term of this patent is extended or adjusted under 35 U.S.C. 154(b) by 140 days.

(21) Appl. No.: 12/323,071

(22) Filed: Nov. 25, 2008

(65) Prior Publication Data

US 2009/0146730 A1 Jun. 11, 2009

(30) Foreign Application Priority Data

Dec. 6, 2007 (TW) ..... 96146506 A

(51) Int. Cl.
*G05F 1/10* (2006.01)

(52) U.S. Cl. ..... 327/539; 327/513; 323/313

(58) Field of Classification Search ..... 327/539
See application file for complete search history.

(56) References Cited

U.S. PATENT DOCUMENTS

| | | | |
|---|---|---|---|
| 6,323,630 | B1 | 11/2001 | Banba |
| 6,501,256 | B1 | 12/2002 | Jaussi et al. |
| 6,501,299 | B2 | 12/2002 | Kim et al. |
| 6,906,581 | B2 | 6/2005 | Kang et al. |
| 6,958,597 | B1 | 10/2005 | Lin et al. |
| 6,987,416 | B2 | 1/2006 | Ker et al. |
| 2004/0155700 | A1 | 8/2004 | Gower et al. |
| 2005/0231270 | A1 | 10/2005 | Washburn |
| 2005/0285666 | A1 | 12/2005 | Garlapati et al. |
| 2006/0006858 | A1 | 1/2006 | Chiu |
| 2006/0043957 | A1 | 3/2006 | Carvalho |

OTHER PUBLICATIONS

Ker et al.; "New Curvature-Compensation Technique for CMOS Bandgap Reference With Sub-1-V Operation", Final manuscript of TCAS-II; IEEE; pp. 1-5.

Leung et al.; "A Sub-1-V 15-ppm/° C CMOS Bandgap Voltage Reference Without Requiring Low Threshold Voltage Device", IEEE Journal of Solid-State Circuits; vol. 37; No. 4; Apr. 2002; pp. 526-530.

Malcovati et al.; "Curvature-Compensated BiCMOS Bandgap with 1-V Supply Voltage", IEEE Journal of Solid-State Circuits; vol. 36; No. 7; Jul. 2001; 6 pages.

Banba et al.; "A CMOS Bandgap Reference Circuit with Sub-1-V Operation", IEEE Journal of Solid-State Circuits; vol. 34; No. 5; May 1999; pp. 670-674.

*Primary Examiner*—Long Nguyen
*Assistant Examiner*—Sibin Chen
(74) *Attorney, Agent, or Firm*—Lowe Hauptman Ham & Berner, LLP

(57) ABSTRACT

A bandgap reference circuit generating bandgap reference voltage/current. The bandgap reference circuit generates a negative temperature coefficient current ($I_{CTAT}$) and the first and the second positive temperature coefficient currents ($I_{PTAT}$ and $I_{NL}$), and compensates the non-constant components of the current $I_{CTAT}$ by multiplying the currents $I_{CTAT}$, $I_{PTAT}$ and $I_{NL}$ by three specially designed numbers $K_1$, $K_2$ and $K_3$, respectively, and then summing up the results. The bandgap reference circuit transforms the summation current ($K_1 \cdot I_{CTAT} + K_2 \cdot I_{PTAT} + K_3 \cdot I_{NL}$) to generate a bandgap reference voltage or a bandgap reference current.

12 Claims, 6 Drawing Sheets

BANDGAP REFERENCE CIRCUIT

CROSS REFERENCE TO RELATED APPLICATIONS

This Application claims priority of Taiwan Patent Application No. 096146506, filed on Dec. 6, 2007, the entirety of which is incorporated by reference herein.

FIELD OF THE INVENTION

The present invention relates to bandgap reference circuits, used to generate bandgap reference voltages or bandgap reference currents.

BACKGROUND

In System-on-Chip (SoC) technology, reference voltages and reference currents for circuit blocks must be accurate and maintain constant values, and not vary with process-voltage-temperature (PVT) variations. Bipolar junction transistor (BJT) is often applied to generate reference voltages/currents.

The base-emitter (pn junction diode) voltage of BJT is symbolized by $V_{BE}$, and is depicted in the following Formula:

$$V_{BE}=V_{GO}-[V_G(T_r)-V_{BE}(T_r)]\cdot T/T_r-(\eta-\beta)V_T\ln(T/T_r), \qquad \text{(Formula 1)}$$

where $V_{GO}$ is the extrapolated bandgap voltage of silicon at 0° K., $T_r$ indicates the room temperature (quantified by ° K.), T is the absolute temperature in degrees Kelvin, η is a temperature-independent and process-dependent constant, and its ranging is less than 4 depending on doping level, β is the order of temperature dependence of the collector current of BJT (i.e. $I_C=I_{CO}\cdot T^{\beta}$), and $V_T$ is the thermal voltage which is directly proportional to T.

Referring to Formula 1, the $V_{BE}$ is disproportional to absolute temperature T. So, the $V_{BE}$ is a negative temperature coefficient voltage, and comprises a constant component $V_{GO}$, a first negative temperature coefficient component $-[V_G(T_r)-V_{BE}(T_r)]T/T_r$, and a second negative temperature coefficient component $-(\eta-\beta)V_T\ln(T/T_r)$. The first negative temperature coefficient component, $-[V_G(T_r)-V_{BE}(T_r)]T/T_r$, is porpornal to absolute temperature T. The second negative temperature coefficient component, $-(\eta-\beta)V_T\ln(T/T_r)$, is a non-linear component with absolute temperature T variations. In order to generate constant reference voltages/currents by $V_{BE}$, the first and the second negative temperature coefficient components in Formula 1, $-[V_G(T_r)-V_{BE}(T_r)]T/T_r$ and $-(\eta-\beta)V_T\ln(T/T_r)$, must be compensated by different compensation techniques. Finally, the constant component $V_{GO}$ in Formula 1 would be left and used to provide constant reference voltages/currents for other circuits. The circuits are used to provide constant reference, which is relationship with $V_{GO}$, voltages/currents are named bandgap reference circuits.

FIG. 1 illustrates a conventional bandgap reference circuit disclosed in *Curvature-Compensated BiCMOS transistor Bandgap with 1-V Supply Voltage, IEEE JSSC,* 2001. The paper transforms the components of the previously described Formula 1, and decreases operational voltages of circuits utilized therein. Referring to FIG. 1, the currents $I_{CATA}$, $I_{PATA}$ and $I_{NL}$ relate to $V_{BE}$, $[V_G(T_r)-V_{BE}(T_r)]T/T_r$, and $(\eta-\beta)V_T\ln(T/T_r)$ of Formula 1, respectively. In FIG. 1, $I_{CTAT}$ equals to $V_{EB2}/R_2$, which is $\{V_{GO}-[V_G(T_r)-V_{BE}(T_r)]T/T_r-(\eta-\beta)V_T\ln(T/T_r)\}/R_2\}$. $I_{CTAT}$ comprises a constant component, $V_{GO}/R_2$, and negative temperature coefficient components, $-[V_G(T_r)-V_{BE}(T_r)]T/(T_rR_2)$, and $-(\eta-\beta)V_T\ln(T/T_r)/R_2$, wherein the first negative temperature coefficient component, $-[V_G(T_r)-V_{BE}(T_r)]T/(T_rR_2)$, is linearly to absolute temperature T variations, and the second negative temperature coefficient component, $-(\eta-\beta)V_T\ln(T/T_r)/R_2$, is non-linear to absolute temperature T variations. The emitter-base (pn junction diode) voltage of BJT ($V_{EB}$) also follows a Formula, wherein $V_{EB}=V_T\ln(I_C/(\text{Area}\cdot J_S))$. Thus, $I_{PATA}$, which equals to $(V_{EB2}-V_{EB1})/R_1$, equals to $[V_T\ln(I_{C2}/(1\cdot J_S))-V_T\ln(I_{C1}/(NJ_S))]/R_1$. Because the two p-type MOS transistors, $M_1$ and $M_2$, are of the same channel width to length ratio, so that the two PNP transistors, $Q_1$ and $Q_2$, have equal collector currents ($I_{C1}=I_{C2}$). Thus, the current $I_{PATA}$, which equals to $[V_T\ln(I_{C2}/(1\cdot J_S))-V_T\ln(I_{C1}/(NJ_S))]/R_1$, equals to $V_T\ln(N)/R_1$. $I_{PATA}$ is a positive temperature coefficient current, which is linear to absolute temperature T variations and is used in compensating for the first negative temperature coefficient component of current $I_{CTAT}$. Furthermore, the paper designs the current flowing through another PNP transistor $Q_3$ to be independent from the absolute temperature T. Thus, based on the Formula 1, the current $I_{NL}$, which equals to $(V_{EB2}-V_{EB3})/R_4$, equals to $\{[V_{GO}-[V_G(T_r)-V_{BE}(T_r)]T/T_r-(\eta-1)V_T\ln(T/T_r)]-[V_{GO}-[V_G(T_r)-V_{BE}(T_r)]T/T_r-\eta V_T\ln(T/T_r)]\}/R_4=V_T\ln(T/T_r)/R_4$. Herein, $I_{NL}$ is a positive temperature coefficient current and is nonlinear to absolute temperature T variations. The paper uses $I_{NL}$ to compensate for the second negative temperature coefficient component of the current $I_{CTAT}$. With elaborately designed resistors $R_1$, $R_2$ and $R_4$, the summation of the currents $I_{CTAT}$, $I_{PATA}$ and $I_{NL}$ is a constant value and is not affected by PVT variations. Thus, the reference voltage $V_{ref}$ generated by the current $(I_{CTAT}+I_{PATA}+I_{NL})$ flowing through the resistor $R_3$ is a constant value which is not affected by PVT variations. The reference voltage $V_{ref}$ is suitable for application in SoC systems.

Referring to FIG. 1, the bandgap reference voltage $V_{ref}$ is based on the current summation $(I_{CTAT}+I_{PATA}+I_{NL})$, and the value of $(I_{CTAT}+I_{PATA}+I_{NL})$ is dependent on the value of the resistors $R_1$, $R_2$ and $R_4$. When a bandgap reference circuit of FIG. 1 is designed, the value of $(I_{CTAT}+I_{PATA}+I_{NL})$ is fixed and can not be adjusted. However, in SoC systems, each of the circuit blocks may require a bandgap reference voltage to fit an exclusive reference voltage curvature. Thus, in conventional techniques, each circuit block of the SoC system must correspond to an exclusive bandgap reference circuit as shown in FIG. 1.

BRIEF SUMMARY OF THE INVENTION

An exemplary example in accordance with the invention discloses bandgap reference circuits generating bandgap reference voltages or bandgap reference currents. The bandgap reference circuit comprises a negative temperature coefficient current generator, a first positive temperature coefficient current generator, a second positive temperature coefficient current generator, a coarse tuning circuit and a transformer. The negative temperature coefficient current generator generates a negative temperature coefficient current comprising a constant component and the first and the second negative temperature coefficient components. The first negative temperature coefficient component is linear to temperature variations and the second negative temperature coefficient component is non-linear to temperature variations. The first positive temperature coefficient current generator generates a first positive temperature coefficient current that is linear to temperature variations and is for compensating the said first negative temperature coefficient component. The second positive temperature coefficient current generator generates a second positive temperature coefficient current that is non-linear to temperature variations and is for compensating the said second negative temperature coefficient component. The coarse tuning circuit multiplies the negative temperature coefficient current, and the first and the second positive temperature coefficient currents by the first, the second and the third numbers, respectively, and sums up the products to generate a coarse-compensated current fitting an ideal curvature relating to the ideal reference voltage/current of the coupled circuit block. The transformer receives the coarse-compensated current and transforms it to a bandgap reference voltage or a bandgap reference current.

The aforementioned negative temperature coefficient current generator and the first and the second positive temperature coefficient current generators may form a core circuit in SoC systems to be shared by all circuit blocks. To provide each circuit block of SoC systems with an exclusive bandgap reference voltage/current, an exclusive coarse tuning circuit and an exclusive transformer for each circuit block is required to be designed.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description shows exemplary embodiments carrying out the invention. This description is made for the purpose of illustrating the general principles of the invention and should not be taken in a limiting sense. The scope of the invention is best determined by reference to the appended claims.

Figure 1:
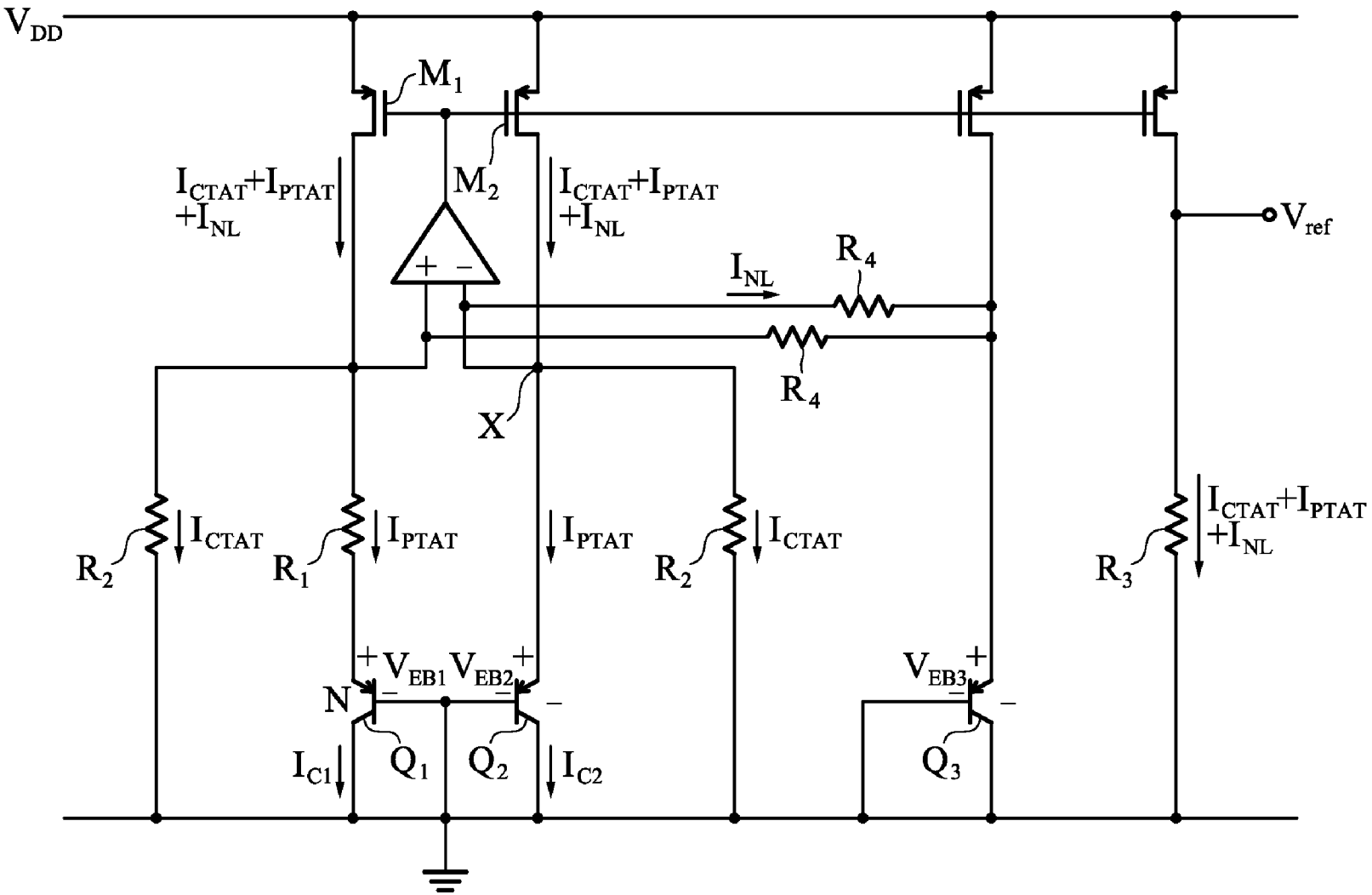
FIG. 1 ( PRIOR ART )
FIG. 1 illustrates a conventional bandgap reference circuit disclosed in *Curvature-Compensated BiCMOS Bandgap with* 1-*V Supply Voltage, IEEE JSSC,* 2001.
Figure 2:
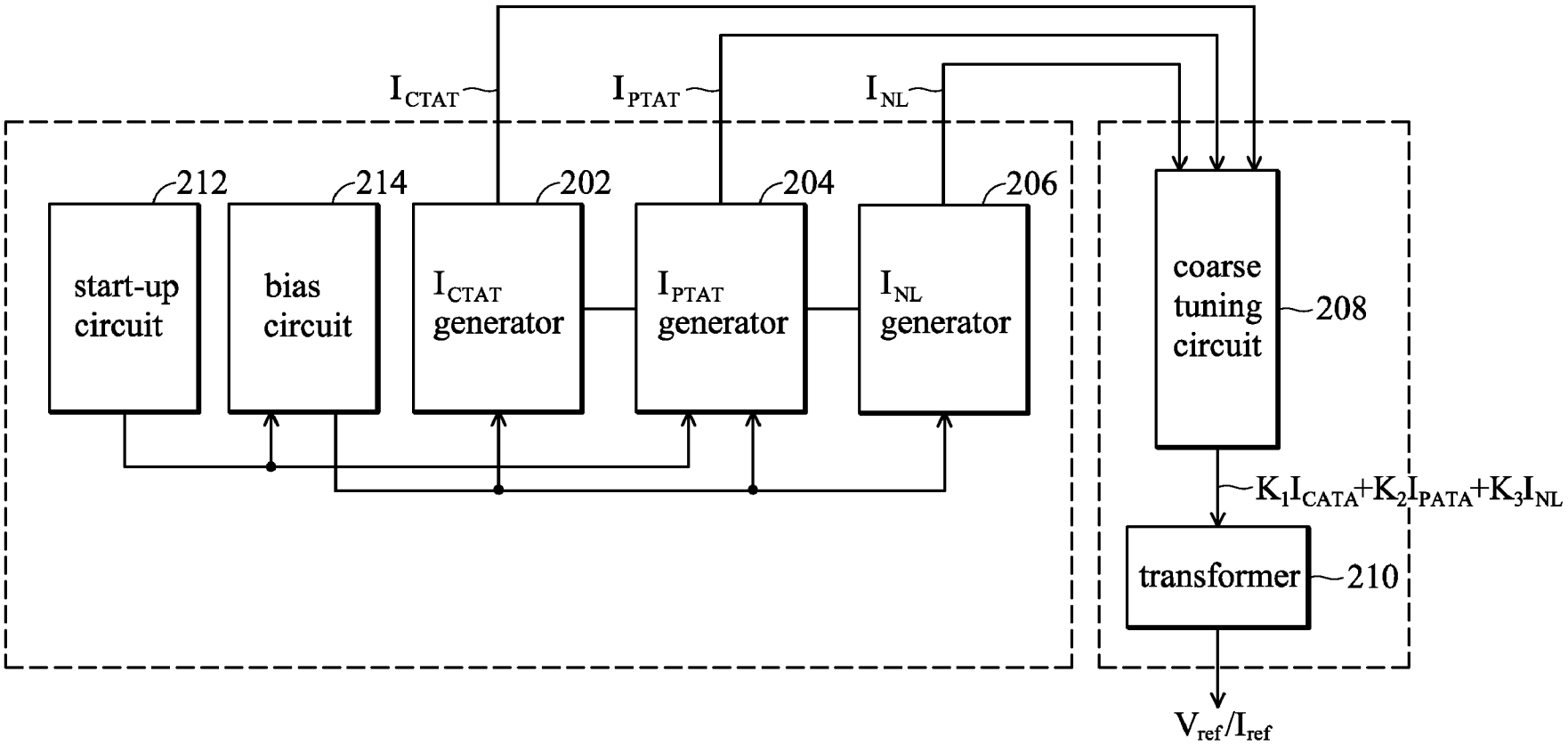
FIG. 2 is a block diagram of an exemplary embodiment of a bandgap reference circuit of the invention.

FIG. 2 is a block diagram of an exemplary embodiment of the invention, which comprises a negative temperature coefficient current generator 202, a first positive temperature coefficient current generator 204, a second positive temperature coefficient current generator 206, a coarse tuning circuit 208 and a transformer 210. The negative temperature coefficient current generator 202 generates a negative temperature coefficient current $I_{CTAT}$, which comprises a constant component, a first negative temperature coefficient component and a second negative temperature coefficient component, wherein the first negative temperature coefficient component is linear to temperature variations and the second negative temperature coefficient component is non-linear to temperature variations. The first positive temperature coefficient current generator 204 generates a first positive temperature coefficient current $I_{PTAT}$ that is linear to temperature variations for compensating the first negative temperature coefficient component of the current $I_{CTAT}$. The second positive temperature coefficient current generator 206 generates a second positive temperature coefficient current $I_{NL}$ that is non-linear to temperature variations for compensating the second negative temperature coefficient component of the current $I_{CTAT}$. The coarse tuning circuit 208 duplicates the currents $I_{CTAT}$, $I_{PTAT}$ and $I_{NL}$ from the current generators 202, 204 and 206, respectively, and multiplies them by the first, the second and the third numbers $K_1$, $K_2$ and $K_3$, respectively. The coarse tuning circuit 208 further sums $K_1 \cdot I_{CTAT}$, $K_2 \cdot I_{PTAT}$ and $K_3 \cdot I_{NL}$, to output a coarse-compensated current $(K_1 \cdot I_{CTAT}+K_2 \cdot I_{PTAT}+K_3 \cdot I_{NL})$. The first, the second and the third numbers $K_1$, $K_2$ and $K_3$ are designed to fit the coarse-compensated current $(K_1 \cdot I_{CTAT}+K_2 \cdot I_{PTAT}+K_3 \cdot I_{NL})$ to an ideal curvature related to the ideal reference voltage/current of the corresponding circuit block. The coarse tuning circuit 208 sends the coarse-compensated current $(K_1 \cdot I_{CTAT}+K_2 \cdot I_{PTAT}+K_3 \cdot I_{NL})$ to the transformer 210 to transform the coarse-compensated current $(K_1 \cdot I_{CTAT}+K_2 \cdot I_{PTAT}+K_3 \cdot I_{NL})$ to a bandgap reference voltage or a bandgap reference current.

In addition to the aforementioned blocks 202-210, the embodiment of FIG. 2 comprises a start-up circuit 212 and a bias circuit 214. The start-up circuit 212 is used to trigger the bias sources in the bandgap reference circuit to operate normally when the power supply of the corresponding SoC system is turned on. The bias circuit 214 provides the negative temperature coefficient current generator 202, the first and the second positive temperature current generators 204 and 206 with the dc bias.

Figure 3:
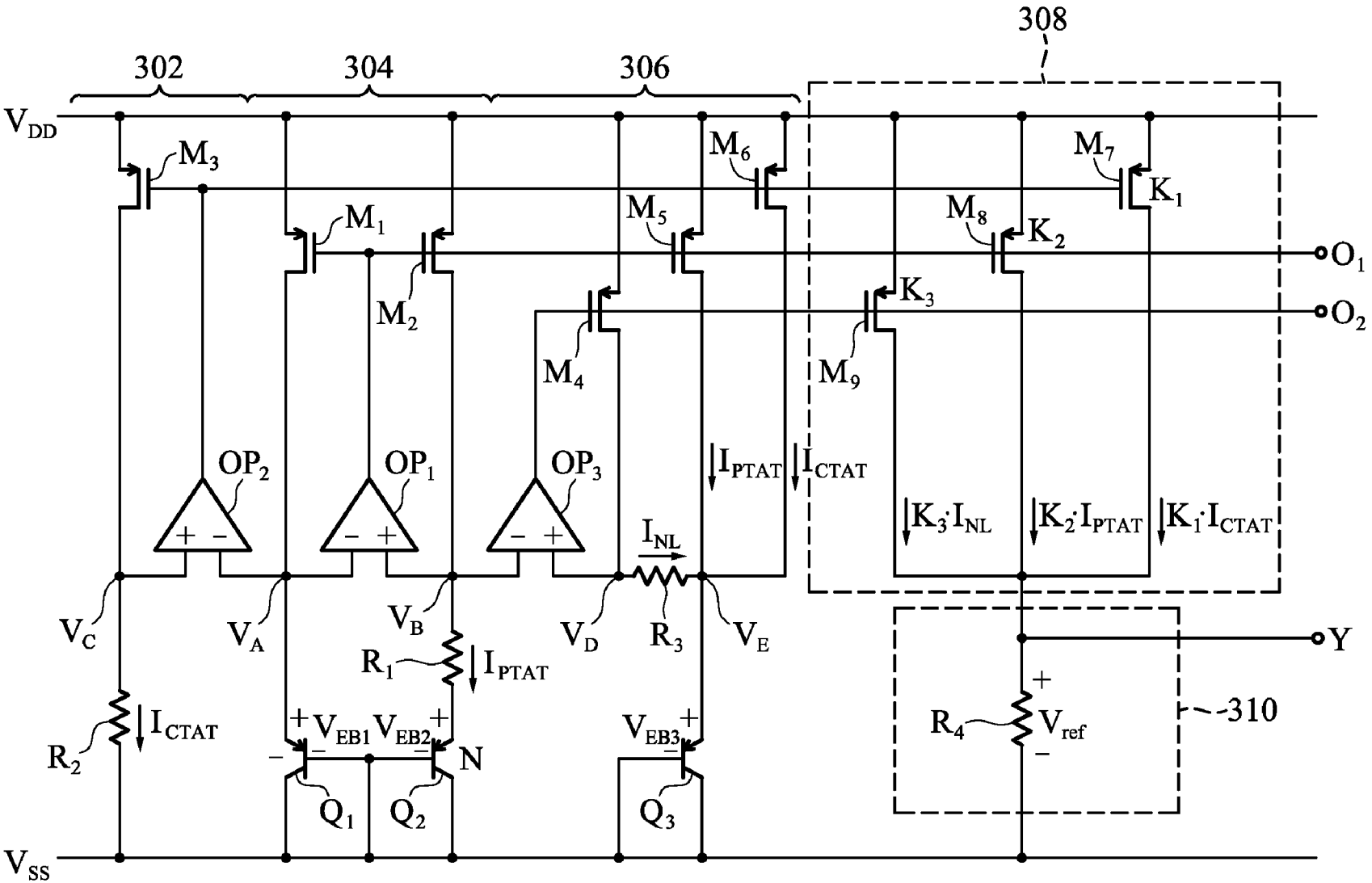
FIG. 3 illustrates an exemplary embodiment of the bandgap reference circuit of the invention.

FIG. 3 illustrates an exemplary embodiment of the bandgap reference circuit of FIG. 2, which comprises a negative temperature coefficient current generator 302, a first positive temperature coefficient current generator 304, a second temperature coefficient current generator 306, a coarse tuning circuit 308 and a transformer 310.

Referring to the circuit of the first positive temperature coefficient current generator 304, the circuit comprises a first Metal Oxide Semiconductor (MOS) transistor $M_1$, a second MOS transistor $M_2$ a first operational amplifier $OP_1$, a first Bipolar Junction Transistor (BJT) $Q_1$, a second BJT $Q_2$ and a resistor $R_1$. The first and second MOS transistors $M_1$ and $M_2$ have coupled gates and coupled sources, wherein the gates are coupled to the output terminal of the first operational amplifier $OP_1$ and the sources are coupled to a first voltage source $V_{DD}$. The operational amplifier $OP_1$ has an inverting input terminal coupled to the drain of the first MOS transistor $M_1$ at a first node (having a voltage level of $V_A$) and a non-inverting input terminal coupled to the drain of the second MOS transistor $M_2$ at the second node (having a voltage level of $V_B$). The first BJT $Q_1$ has an emitter coupled to the first node, and has a base and a collector coupled together to a second voltage source $V_{SS}$. The second BJT $Q_2$ has an emitter coupled to the non-inverting input terminal of the first operational amplifier $OP_1$ via the first resistor $R_1$, and has a base and a collector coupled to the second voltage source $V_{SS}$.

In this embodiment, the first and the second BJTs $Q_1$ and $Q_2$ are of the same material and their channel areas are in a ratio of 1:N, and the first and the second MOS transistor transistors $M_1$ and $M_2$ are of the same channel width to length ratio ($I_{C1}=I_{C2}$). Because of the virtual ground between the input terminals of the first operational amplifier $OP_1$, the first and the second nodes are of equal voltage levels, wherein $V_A=V_B=V_{EB1}$. Thus, the current $I_{PTAT}$ is as follows:

$$I_{PTAT} = \frac{V_{EB1} - V_{EB2}}{R_1}$$

-continued $$= \frac{1}{R_1} \cdot \left[ V_T \cdot \ln\left(\frac{I_{C1}}{1 \cdot J_S}\right) - V_T \cdot \ln\left(\frac{I_{C2}}{N \cdot J_S}\right) \right]$$

$$= \frac{\ln(N)}{R_1} V_T \Big|_{I_{C1}=I_{C2}} .$$

Because the thermal voltage $V_T$ is linear to temperature variations and is a positive temperature coefficient value, the current $I_{PTAT}$ is a positive temperature coefficient current and is linear to temperature variations. The current $I_{PTAT}$ is the first positive temperature coefficient generated by the generator 304.

Referring to the circuit of the negative temperature coefficient current generator 302, the circuit comprises a third MOS transistor $M_3$, a second operational amplifier $OP_2$ and a second resistor $R_2$. The third MOS transistor M3 has a source coupled to the first voltage source $V_{DD}$. The second operational amplifier $OP_2$ has an output terminal coupled to the gate of the third MOS transistor $M_3$, an inverting input terminal coupled to the first node, and a non-inverting input terminal coupled to the second resistor $R_2$ at a third node (of a voltage level $V_C$). The second resistor $R_2$ is coupled between the third node and the second voltage source $V_{SS}$. The drain of the third MOS transistor $M_3$ is coupled to the third node.

Because of the virtual ground between the input terminals of the second operational amplifier $OP_2$, the voltage level of the third node equals to the voltage level of the first node, wherein $V_C=V_A=V_{EB1}$. The current $I_{CTAT}$ through the second resistor $R_2$ is as follows:

$$I_{CTAT} = \frac{V_{EB1}}{R_2}$$

$$= \frac{1}{R_2} \cdot \left\{ V_{GO} - [V_G(T_r) - V_{BE}(T_r)] \cdot \frac{T}{T_r} - (\eta - \beta) V_T \ln\left(\frac{T}{T_r}\right) \right\}.$$

The current $I_{CATA}$ increases when the temperature T decreases, and has a constant component $V_{GO}/R_2$, a first negative temperature coefficient component $-[V_G(T_r)-V_{BE}(T_r)]T/(R_2T_r)$, and a second negative temperature coefficient component $-(\eta-\beta)V_T \ln(T/T_r)/R_2$. The first negative temperature coefficient component $-[V_G(T_r)-V_{BE}(T_r)]T/(R_2T_r)$ is linear to temperature variations and the second negative temperature coefficient component $-(\eta-\beta)V_T \ln(T/T_r)/R_2$ is non-linear to temperature variations. The current $I_{CTAT}$ is the negative temperature coefficient current generated by the negative temperature coefficient current generator 302.

Referring to the circuit of the second positive temperature current generator 306, the circuit comprises a fourth MOS transistor $M_4$, a fifth MOS transistor $M_5$, a sixth MOS transistor $M_6$, a third operational amplifier $OP_3$, a third BJT $Q_3$ and a third resistor $R_3$. The sources of the fourth, the fifth and the sixth MOS transistors $M_4$, $M_5$ and $M_6$, are coupled to the first voltage source $V_{DD}$. The third operational amplifier $OP_3$ has an output terminal coupled to the gate of the fourth MOS transistor $M_4$, an inverting input terminal coupled to the second node, and a non-inverting input terminal coupled to the first terminal of the third resistor $R_3$ at a fourth node (having a voltage level of $V_D$). The drain of the fourth MOS transistor $M_4$ is coupled to the fourth node. The gate of the fifth MOS transistor $M_5$ is coupled to the gate of the second MOS transistor $M_2$ to duplicate the current flowing through the second MOS transistor $M_2$ ($I_{PTAT}$). The gate of the sixth MOS transistor $M_6$ is coupled to the gate of the third MOS transistor $M_3$ to duplicate the current flowing through the third MOS transistor $M_3$ ($I_{CTAT}$). The second terminal of the third resistor $R_3$ is coupled to the drains of the fifth and sixth MOS transistors $M_5$ and $M_6$ at a fifth node (having a voltage level of $V_E$). The third BJT $Q_3$ has an emitter coupled to the fifth node, and has a base and a collector coupled together to the second voltage source $V_{SS}$.

Because of the virtual ground between the input terminals of the third operational amplifier $OP_3$, the voltage of the fourth node equals t the voltage of the second node. Thus, $V_D=V_B=V_A=V_{EB1}$. The current $I_{NL}$ is $(V_{EB1}-V_{EB3})/R_3$. Because the current flowing through the first BJT $Q_1$, $I_{PTAT}$, is linear to temperature variations, the parameter β of the pn junction voltage $V_{EB1}$ is 1. Because the current flowing through the third BJT $Q_3$ ($I_{CTAT}+I_{PTAT}+I_{NL}$) is designed to be a constant value that is not affected by the temperature variations, the parameter β of the pn junction voltage $V_{EB3}$ is 0. Thus, The emitter-base (pn junction diode) voltage of BJTs $Q_1$ and $Q_3$ follow the following equations:

$$V_{EB1} = V_{GO} - [V_G(T_r) - V_{BE}(T_r)] \cdot \frac{T}{T_r} - (\eta - 1) V_T \ln\left(\frac{T}{T_r}\right), \text{ and}$$

$$V_{EB3} = V_{GO} - [V_G(T_r) - V_{BE}(T_r)] \cdot \frac{T}{T_r} - \eta V_T \ln\left(\frac{T}{T_r}\right).$$

Thus, the current $I_{NL}$ is $V_T \ln(T/T_r)/R_3$. The current $I_{NL}$ is the second positive temperature coefficient current generated by the second positive temperature coefficient current generator 306.

Referring to the circuit of the coarse tuning circuit 308, the coarse tuning circuit 308 comprises a seventh MOS transistor $M_7$, an eighth MOS transistor $M_8$ and a ninth MOS transistor $M_9$. The sources of the seventh, eighth and ninth MOS transistors $M_7$, $M_8$ and $M_9$ are coupled to the first voltage source $V_{DD}$. The seventh MOS transistor $M_7$ has a gate coupled to the gate of the third MOS transistor $M_3$, and the channel width to length ratios of the seventh and third MOS transistors M7 and M3 are in a ratio of $1:K_1$. Thus, the current flowing through the seventh MOS transistor $M_7$ is $K_1 \cdot I_{CTAT}$. The eighth MOS transistor $M_8$ has a gate coupled to the gate of the second MOS transistor $M_2$, and the channel width to length ratios of the eighth and second MOS transistors $M_8$ and $M_2$ are in a ratio of $1:K_2$. Thus, the current flowing through the eighth MOS transistor $M_8$ is $K_2 \cdot I_{PTAT}$. The ninth MOS transistor $M_9$ has a gate coupled to the gate of the fourth MOS transistor $M_4$, and the channel width to length ratios of the ninth and fourth MOS transistors $M_9$ and $M_4$ are in a ratio of $1:K_3$. Thus, the current flowing through the ninth MOS transistor $M_9$ is $K_3 \cdot I_{NL}$. The drains of the seventh, the eighth, and the ninth MOS transistors $M_7$, $M_8$ and $M_9$ are coupled together to output a summation of the currents $K_1 \cdot I_{CTAT}$, $K_2 \cdot I_{PTAT}$ and $K_3 \cdot I_{NL}$. The summation current ($K_1I_{CTAT}+K_2I_{PTAT}+K_3I_{NL}$) is the coarse-compensated current generated by the coarse tuning circuit 308.

In the embodiment shown in FIG. 3, the transformer 310 is realized by a fourth resistor $R_4$. The voltage across the fourth resistor $R_4$ is the bandgap reference voltage $V_{ref}$.

Figure 4:
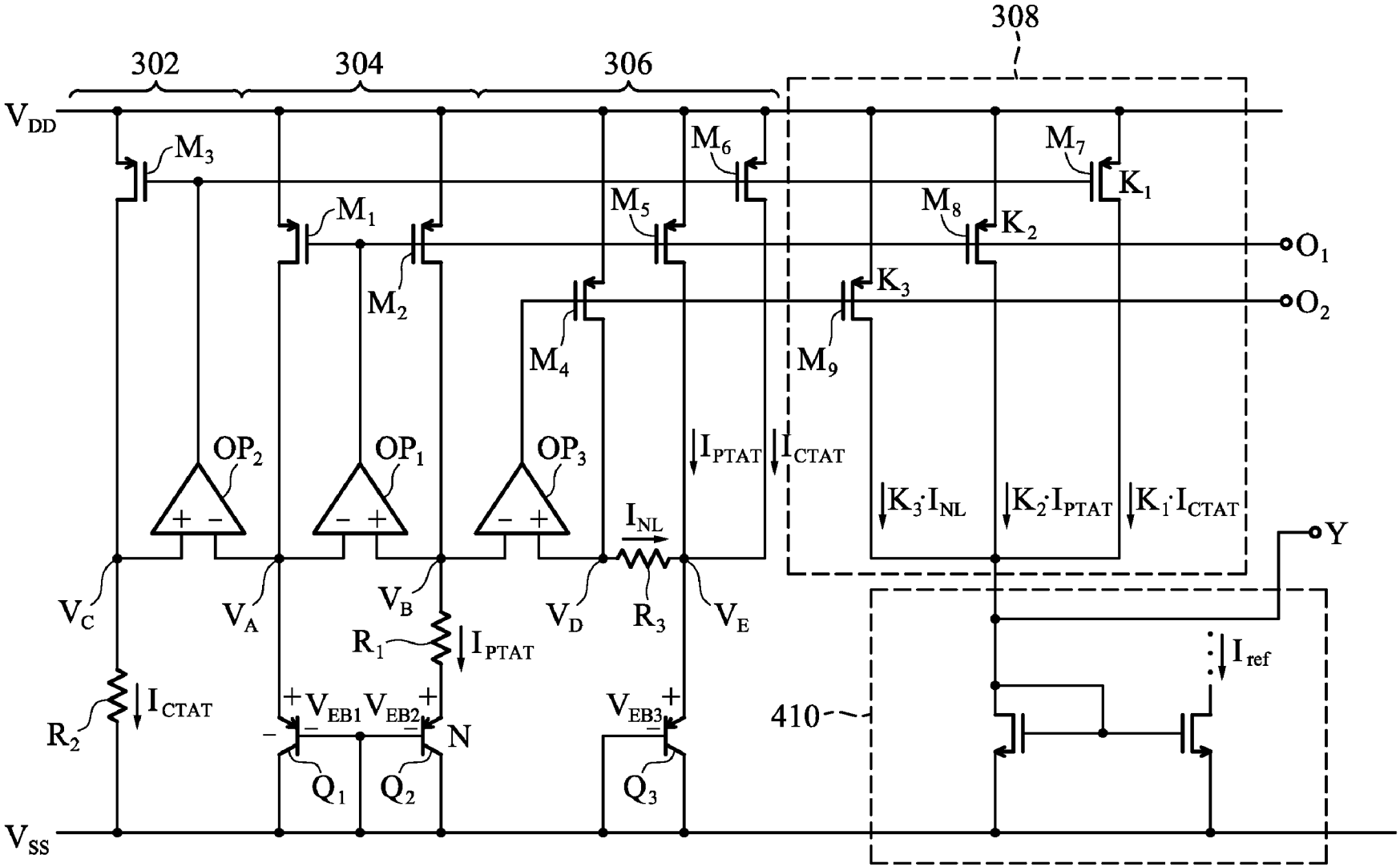
FIG. 4 illustrates another exemplary embodiment of the bandgap reference circuit of the invention.

FIG. 4 illustrates another exemplary embodiment of the invention, wherein the transformer 410 is a current mirror, which duplicates the coarse-compensated current ($K_1I_{CTAT}+K_2I_{PTAT}+K_3I_{NL}$) or amplifies the coarse-compensated current ($K_1I_{CTAT}+K_2I_{PTAT}+K_3I_{NL}$) to generate a bandgap reference current $I_{ref}$.

The invention generates the currents $I_{CTAT}$, $I_{PTAT}$ and $I_{NL}$ by three circuits. The MOS transistors $M_3$, $M_2$ and $M_4$ of the circuits 302, 304 and 306 can be coupled to external circuits for duplicating the value of the currents $I_{CTAT}$, $I_{PTAT}$ and $I_{NL}$. In an SOC system, the circuits 302, 304 and 306 form a core generating the currents $I_{CTAT}$, $I_{PTAT}$ and $I_{NL}$. The engineer may design distinct coarse tuning circuits 308 and transformers 310 (or 410) for the different circuit blocks of the SOC system to produce suitable bandgap reference voltages or currents for every circuit blocks.

Figure 5:
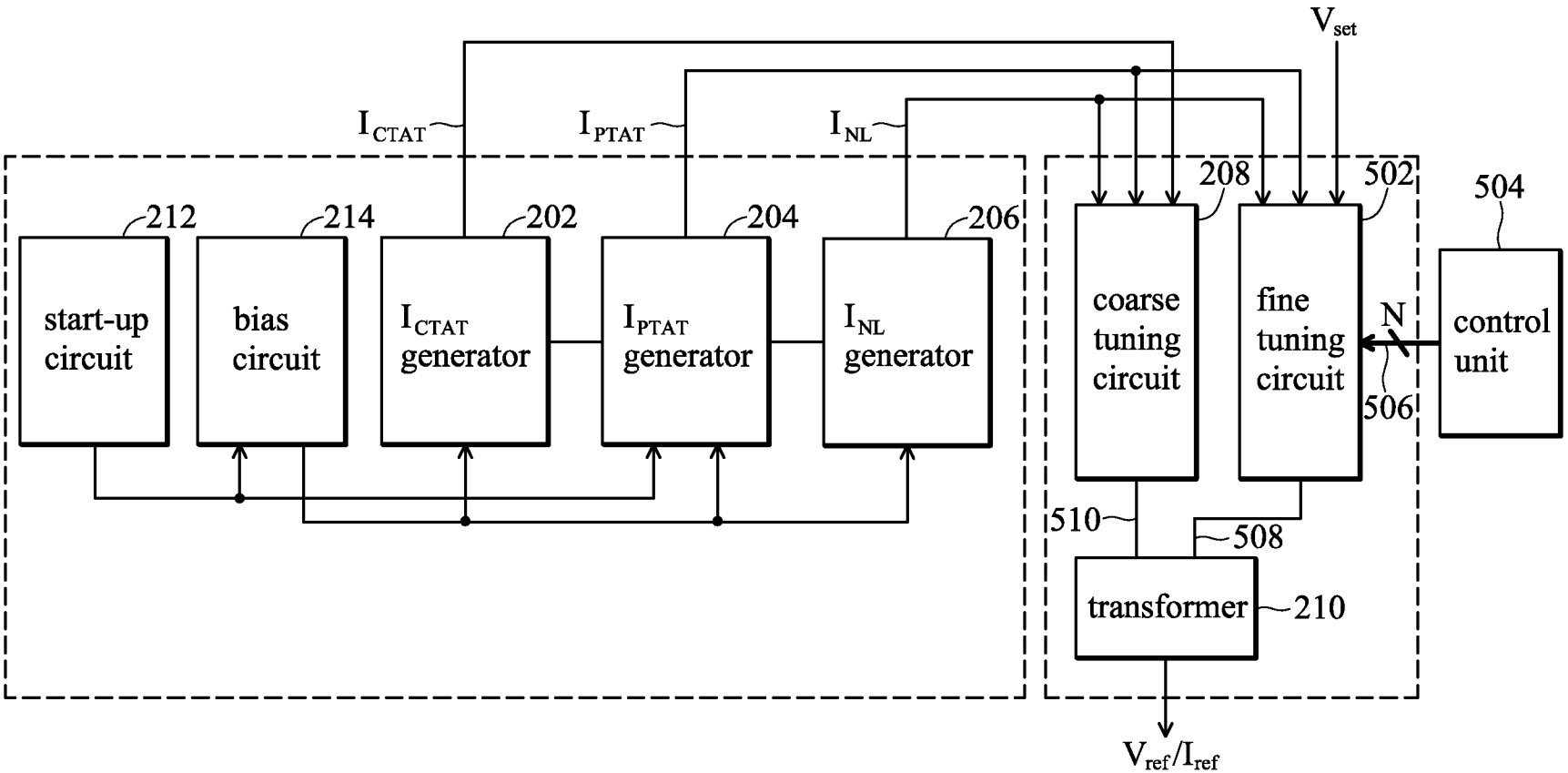
FIG. 5 is a block diagram of a bandgap reference circuit with fine tuning functions.

The invention further discloses bandgap reference circuits with fine tuning functions, wherein FIG. 5 is a block diagram of one of the embodiments. Compared with FIG. 2, FIG. 5 further comprises a fine tuning circuit 502 and a control unit 504. In a test mode, the control unit 504 controls the fine tuning circuit 502 by sets of control signals. The test results are summed with the coarse-compensated current 510 to generate fine-compensated currents. The control unit 504 compares the fine-compensated currents with an ideal curvature relating to the ideal reference current/voltage of the coupled circuit block. The control unit 504 determines the control signal set having the fittest fine-compensated current as the best set of control signals. In a work mode, the fine tuning circuit 502 is controlled by the best set of control signals to generate a fine-tuning current 508. The transformer 210 receives not only the coarse-compensated current 510 but also the fine-tuning current 508, and transforms the summation of the currents 510 and 508 to a bandgap reference voltage/current for the circuit block.

Figure 6:
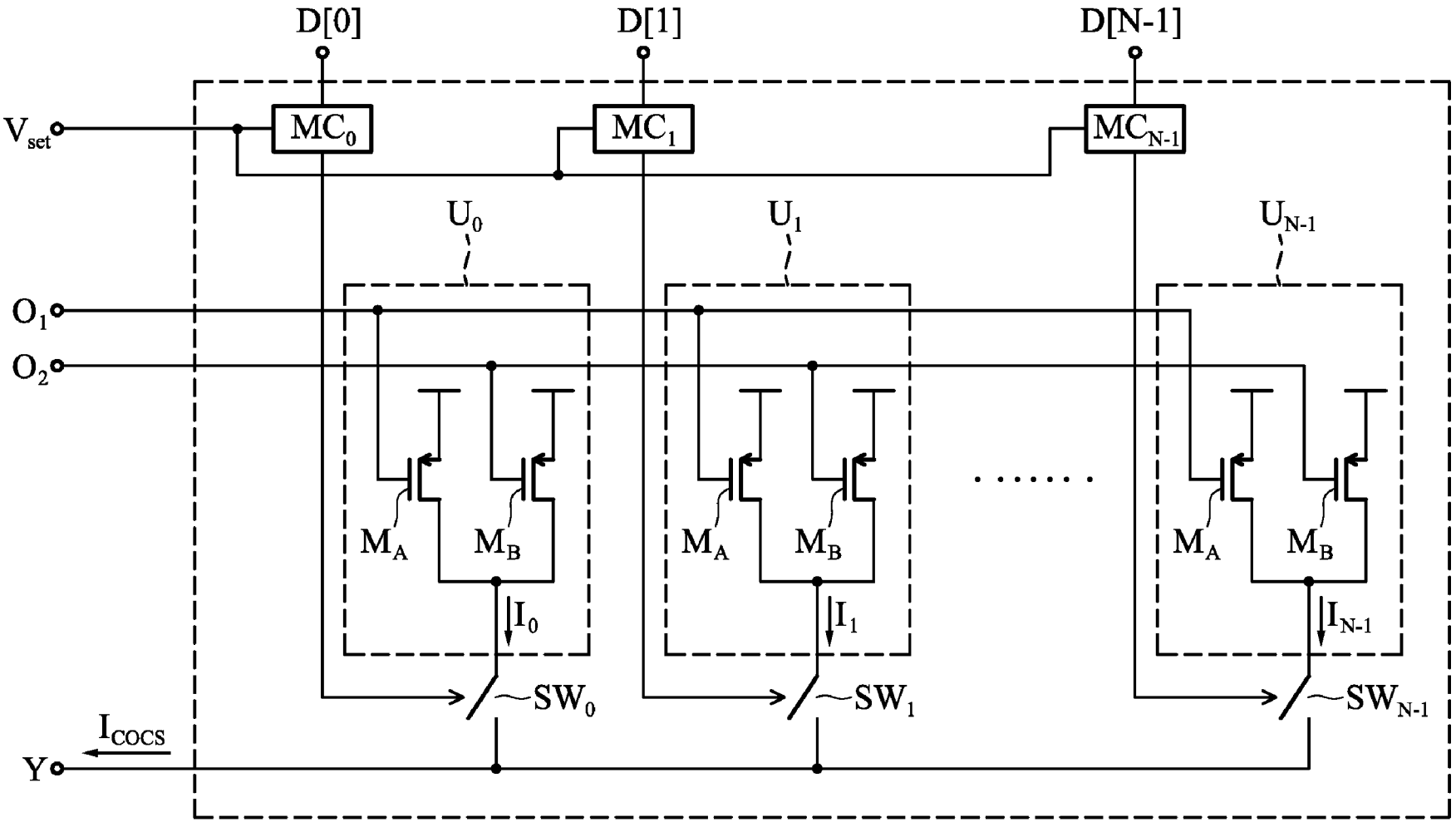
FIG. 6 illustrates an exemplary embodiment of the fine tuning circuit.

FIG. 6 illustrates an exemplary embodiment of the fine tuning circuit, which comprises a plurality of current generating units $U_0$-$U_{N-1}$, a plurality of switches $SW_0$-$SW_{N-1}$, and a plurality of memory cells $MC_0$-$MC_{N-1}$. The current generating units $U_0$-$U_{N-1}$ generate currents $I_0$-$I_{N-1}$, and are coupled to the output terminal of the fine tuning circuit (Y) by the switches $SW_0$-$SW_{N-1}$. The states of the switches $SW_0$-$SW_{N-1}$ are controlled by the output signals of the memory cells $MC_0$-$MC_{N-1}$. The memory cells $MC_0$-$MC_{N-1}$ are controlled by a setting signal $V_{set}$. In the test mode, the setting signal $V_{set}$ drives the memory cells $MC_0$-$MC_{N-1}$ to pass their input signals D[0]-D[N-1] (a set of control signals) to their output terminals. Thus, in the test mode, the fine tuning circuit outputs a fine-tuning current $I_{COCS}$, called curvature optimized current source, which equals to $D[0]I_0+D[1]I_1+\ldots+D[N-1]I_{N-1}$. The control unit 504 provides sets of control the fine tuning circuit, and stores a best control signal set in the memory cells $MC_0$-$MC_{N-1}$ based on the test result. Then, the mode setting signal $V_{set}$ switches to another state to set the fine tuning circuit to a work mode. The switch of the mode setting signal $V_{set}$ drives the memory cells $MC_0$-$MC_{N-1}$ to output the stored data. Thus, in the work mode, the switches $SW_0$-$SW_{N-1}$ are controlled by the best control signal set, and the fine tuning current $I_{COCS}$ perfectly fits the ideal curvature relating to the ideal reference current/voltage of the circuit block. The fine-tuning current $I_{COCS}$ is sent into the transformer 310 or 410 via the terminal Y.

In the embodiment shown in FIG. 6, the fine tuning current $I_{COCS}$ is dependent on the first positive temperature coefficient current $I_{PTAT}$ and the second positive temperature coefficient current $I_{NL}$. Via the nodes $O_1$ and $O_2$, the current generating units $U_0$-$U_{N-1}$ are coupled to the first and the second positive temperature coefficient current generators 304 and 306 to duplicate the first and the second positive temperature coefficient currents $I_{PTAT}$ and $I_{NL}$.

For example, when the channel width to length ratio (W/L) of the MOS transistor $M_A$ of the current generating unit $U_0$ is $K_4$ times that of the MOS transistor $M_2$, the MOS transistors $M_A$ of the current generating units $U_0$-$U_{N-1}$ are in a ratio of $1:2^1:\ldots:2^{(N-1)}$, the W/L of the MOS transistor $M_B$ of the current generating unit $U_0$ is K5 times that of the MOS transistor $M_4$, and the MOS transistors $M_B$ of the current generating units $U_0$-$U_{N-1}$ are in a ratio of $1:2^1:\ldots:2^{(N-1)}$, the current $I_0$ is $K_4I_{PTAT}+K_5I_{NL}$, current $I_1$ is $2^1K_4I_{PTAT}+2^1K_5I_{NL}$, ... and the current $I_{N-1}$ is $2^{(N-1)}K_4I_{PTAT}+2^{(N-1)}K_5I_{NL}$.

In other embodiments, the fine tuning circuit may refer to the first positive temperature coefficient current $I_{PTAT}$, wherein the current generating units $U_0$-$U_{N-1}$ are coupled to the first positive temperature coefficient generator 304. In other embodiments, the fine tuning circuit may refer to the second positive temperature coefficient current $I_{NL}$, wherein the current generating units $U_0$-$U_{N-1}$ are coupled to the second positive temperature coefficient generator 306.

The bandgap reference circuit with the aforementioned fine tuning function performs perfectly on circuits with parasitical components or process corner variations on IC manufacturing phase. Additionally, the generated bandgap reference voltages/currents can perfectly fit the ideal reference voltages/currents of the circuit blocks of an SoC chip.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bandgap reference circuit, comprising a negative temperature coefficient current generator, generating a negative temperature coefficient current comprising a constant component, a first negative temperature coefficient component and a second negative temperature coefficient component, wherein the first negative temperature coefficient component is linear to temperature variations and the second negative temperature coefficient component is non-linear to temperature variations;

a first positive temperature coefficient current generator, generating a first positive temperature coefficient current that is linear to temperature variations and is for compensating the first negative temperature coefficient component;

a second positive temperature coefficient current generator, generating a second positive temperature coefficient current that is non-linear to temperature variations and is for compensating the second negative temperature coefficient component;

a coarse tuning circuit, multiplying the negative temperature coefficient current, the first positive temperature coefficient current and the second positive temperature coefficient current by a first number, a second number and a third number, respectively, to generate a first current, a second current and a third current, and summing up the first, second and third currents to generate a coarse-compensated current fitting an ideal curvature; and a transformer, receiving the coarse-compensated current and converting the coarse-compensated current to a bandgap reference voltage or a bandgap reference current.

2. The bandgap reference circuit as claimed in claim 1, wherein the first positive temperature coefficient current generator comprises:

a first MOS transistor and a second MOS transistor, each having a gate, a source and a drain, wherein the gate of the first MOS transistor is connected to the gate of the second MOS transistor, and the sources of the first and second MOS transistors are both coupled to a first voltage source;

a first operational amplifier, having an output terminal coupled to the gates of the first and second MOS transistors, an inverting input terminal coupled to the drain of the first MOS transistor at a first node, and a non-inverting input terminal coupled to the drain of the second MOS transistor at a second node, a first BJT, having an emitter coupled to the first node, and having a base and a collector that are coupled to a second voltage source; and a first resistor and a second BJT, coupled in series between the second node and the second voltage source, wherein the first resistor is coupled between the second node and an emitter of the second BJT, and a base and a collector of the second BJT are coupled to the second voltage source, wherein the first resistor conveys the first positive temperature coefficient current.

3. The bandgap reference circuit as claimed in claim 2, wherein the negative temperature coefficient current generator comprises:

a third MOS transistor, having a gate, a drain and a source, wherein the source of the third MOS transistor is coupled to the first voltage source;

a second operational amplifier, having an output terminal coupled to the gate of the third MOS transistor, an inverting input terminal coupled to the first node, and a non-inverting input terminal coupled to the drain of the third MOS transistor at a third node; and a second resistor, coupled between the third node and the second voltage source, wherein the second resistor conveys the negative temperature coefficient current.

4. The bandgap reference circuit as claimed in claim 3, wherein the second positive temperature coefficient current generator comprises:

a fourth MOS transistor, having a gate, a drain and a source, wherein the source of the fourth MOS transistor is coupled to the first voltage source;

a third operational amplifier, having an output terminal coupled to the gate of the fourth MOS transistor, an inverting input terminal coupled to the second node, and a non-inverting input terminal coupled to the drain of the fourth MOS transistor at a fourth node;

a fifth MOS transistor, having a gate, a drain and a source, wherein the source of the fifth MOS transistor is coupled to the first voltage source, and the gate of the fifth MOS transistor is coupled to the gate of the second MOS transistor;

a sixth MOS transistor, having gate, a drain and a source, wherein the source of the sixth MOS transistor is coupled to the first voltage source, the gate of the sixth MOS transistor is coupled to the gate of the third MOS transistor, and the drain of the sixth MOS transistor is coupled to the drain of the fifth MOS transistor at a fifth node;

a third resistor, coupled between the fourth and fifth nodes; and a third BJT, having an emitter coupled to the fifth node, and having a base and a collector coupled to the second voltage source, wherein the third resistor conveys the second positive temperature coefficient current.

5. The bandgap reference circuit as claimed in claim 4, wherein the coarse tuning circuit comprises:

a seventh MOS transistor, having a gate, a drain and a source, wherein the source of the seventh MOS transistor is coupled to the first voltage source and the gate of the seventh MOS transistor is coupled to the gate of the third MOS transistor, and the seventh MOS transistor has a channel width to length ratio that is $K_1$ times that of the third MOS transistor, where $K_1$ is the first number;

an eighth MOS transistor, having a gate, a drain and a source, wherein the source of the eighth MOS transistor is coupled to the first voltage source and the gate of the eighth MOS transistor is coupled to the gate of the second MOS transistor, and the eighth MOS transistor has a channel width to length ratio that is $K_2$ times that of the second MOS transistor, where $K_2$ is the second number; and a ninth MOS transistor, having a gate, a drain and a source, wherein the source of the ninth MOS transistor is coupled to the first voltage source and the gate of the ninth MOS transistor is coupled to the gate of the fourth MOS transistor, and the ninth MOS transistor has a channel width to length ratio that is $K_3$ times that of the fourth MOS transistor, where $K_3$ is the third number, wherein the drains of the seventh, eighth and ninth MOS transistors are coupled together as an output terminal of the coarse tuning circuit.

6. The bandgap reference circuit as claimed in claim 1, wherein the transformer is a fourth resistor, and a voltage across the fourth resistor is the bandgap reference voltage.

7. The bandgap reference circuit as claimed in claim 1, wherein the transformer is a current mirror generating the bandgap reference current based on the coarse-compensated current.

8. The bandgap reference circuit as claimed in claim 1, further comprising a fine tuning circuit, generating a fine-tuning current for the transformer based on a best control signal set.

9. The bandgap reference circuit as claimed in claim 8, wherein the best control signal set is determined by a control unit, which tests the fine tuning circuit by control signal sets, sums test results with the coarse-compensated current to generate fine-compensated currents and selects the control signal set which has a fine-compensated current that fits the ideal curvature to be the best control signal set.

10. The bandgap reference circuit as claimed in claim 9, wherein the fine tuning circuit comprises:

a plurality of current generating units;

a plurality of switches, coupled between the current generating units and an output terminal of the fine-tuning circuit, wherein the output terminal of the fine-tuning circuit is operable to output the fine-tuning current; and a plurality of memory cells, having output terminals coupled to control terminals of the switches, wherein, in a test mode, the memory cells transmit the control signal sets provided by the control unit to the control terminals of the switches;

wherein, after the test mode, the memory cells store the best control signal set, and wherein, in a work mode, the memory cell outputs the best control signal set to the control terminals of the switches.

11. The bandgap reference circuit as claimed in claim 10, wherein the current generating units output currents related to the first positive temperature coefficient current.

12. The bandgap reference circuit as claimed in claim 10, wherein the current generating units output currents related to the second positive temperature coefficient current.

* * * * *